US008042293B1

(12) United States Patent
Bennett et al.

(10) Patent No.: US 8,042,293 B1
(45) Date of Patent: Oct. 25, 2011

(54) ARTICLE ENCIRCLING BAND WITH REMOVABLE COUPON OR TICKET

(75) Inventors: Robert C. Bennett, Edina, MN (US); Ralph J. Mallozzi, Stony Point, NY (US)

(73) Assignee: Hoffmaster Group, Inc., Oshkosh, WI (US)

( * ) Notice: Subject to any disclaimer, the term of this patent is extended or adjusted under 35 U.S.C. 154(b) by 500 days.

(21) Appl. No.: 12/068,018

(22) Filed: Jan. 31, 2008

Related U.S. Application Data

(60) Provisional application No. 60/898,395, filed on Jan. 31, 2007.

(51) Int. Cl.
*G09F 3/04* (2006.01)

(52) U.S. Cl. ..... 40/665; 40/674; 428/43; 428/194; 24/17 B

(58) Field of Classification Search ..... 428/43, 428/194, 354; 40/633, 674; 283/103, 105, 283/81; 24/17 A, 17 AP, 17 B
See application file for complete search history.

(56) References Cited

U.S. PATENT DOCUMENTS 1,356,053 A * 10/1920 Dunning ..... 40/638
1,609,731 A * 12/1926 Lechner ..... 40/665
2,000,763 A * 5/1935 Lane ..... 24/17 R

* cited by examiner

*Primary Examiner* — Alexander Thomas
(74) *Attorney, Agent, or Firm* — Boyle Fredrickson, S.C.

(57) ABSTRACT

A combination article encircling band and coupon or ticket wherein the band is formed by overlapping and contacting spaced adhesive areas formed on opposite surfaces of a strip of material and the coupon or ticket is severable along a line of weakness in the strip material from the band. The combination may be use for advertising and promoting purposes such that information indicia on the band may be related to information indicia on the coupon or ticket.

11 Claims, 3 Drawing Sheets

ARTICLE ENCIRCLING BAND WITH REMOVABLE COUPON OR TICKET

CROSS REFERENCE TO RELATED APPLICATIONS

This application claims the benefit of U.S. Provisional Patent Application Ser. No. 60/898,395, filed Jan. 31, 2007, entitled Article Encircling Band with Removable Coupon or Ticket, in the name of the same inventors. The entire Provisional Patent Application is incorporated herein by reference.

BACKGROUND OF THE INVENTION

1. Field of the Invention

This application is directed to disposable bands that are used to encircle and bind stacked, rolled or closely assembled items or articles and more particularly to such bands that include a separable portion that may function as a bonus coupon, ticket or the like for promotional advertising and the like.

2. Brief Description of the Related Art

Paper and plastic bands are used to bind many products such as stacks of currency, cards, paper and the like to maintain the items in an orderly arrangement in overlaying relationship with one another. In other areas, bands are used to retain articles in rolled, folded or assembled configurations, such as bands used to retain napkins in rolled configurations prior to use by patrons. The bands are initially formed of paper or plastic strips having co-adhesive areas applied at opposite ends and on opposite sides of faces of strips of material such that when the strips are formed or wrapped about an object, such as a rolled napkin, the co-adhesive areas contact with one another to retain the strips in continuous bands. Such continuous bands retain the objects in pre-determined configurations until the bands are severed, such as by tearing.

In many instances, the paper or plastic bands may also be used for advertising purposes. Generally, printed indicia may be applied to an outer face of the strips before the strips are wrapped about and adhered to form continuous bands.

Because such paper and plastic bands may be formed economically from flat stock, they offer an inexpensive but highly reliable way of binding objects until the objects are to be put to use.

SUMMARY OF THE INVENTION

The present invention is directed to combination disposable bands and coupons or tickets that are formed of flat sheet stock material such as paper and some plastics. The material is formed into strips that may be preprinted in sheet form or printed after being formed in strips. A co-adhesive is applied to a first area of an upper surface and adjacent one end of each strip which first area is designed to adhere to another or second area of co-adhesive that is applied to an opposite surface of each strip so as to be spaced inwardly relative to an opposite or second end of the strip.

With the present invention, a section of each strip between the second end and the second area of co-adhesive is designed to serve as a separable coupon of ticket. In this respect, a line of weakness is provided across each strip between the second area adhesive and the second end of each strip. As the section of the strip between the second end and the second area of co-adhesive is designed to serve as a separable coupon or ticket, the length of the section may vary depending on the size of the coupon or ticket and the advertising or other indicia which is to be applied thereto.

The strips of the present invention are designed to be wrapped about an article or plurality of articles such that the first and second adhesive areas come into contact with one another and form continuous bands. Thereafter, the coupon or ticket sections of the strips that now protrude from the bands may be severed at the lines of weakness so that the coupons or tickets may be used for some secondary purposes. In some instances, the coupon or ticket sections may be removed prior to forming the strips into circular bands.

BRIEF DESCRIPTION OF THE DRAWINGS

A better understanding of the invention will be had with reference to the accompanying drawing figures wherein.

DESCRIPTION OF THE PREFERRED EMBODIMENT

Figure 1:
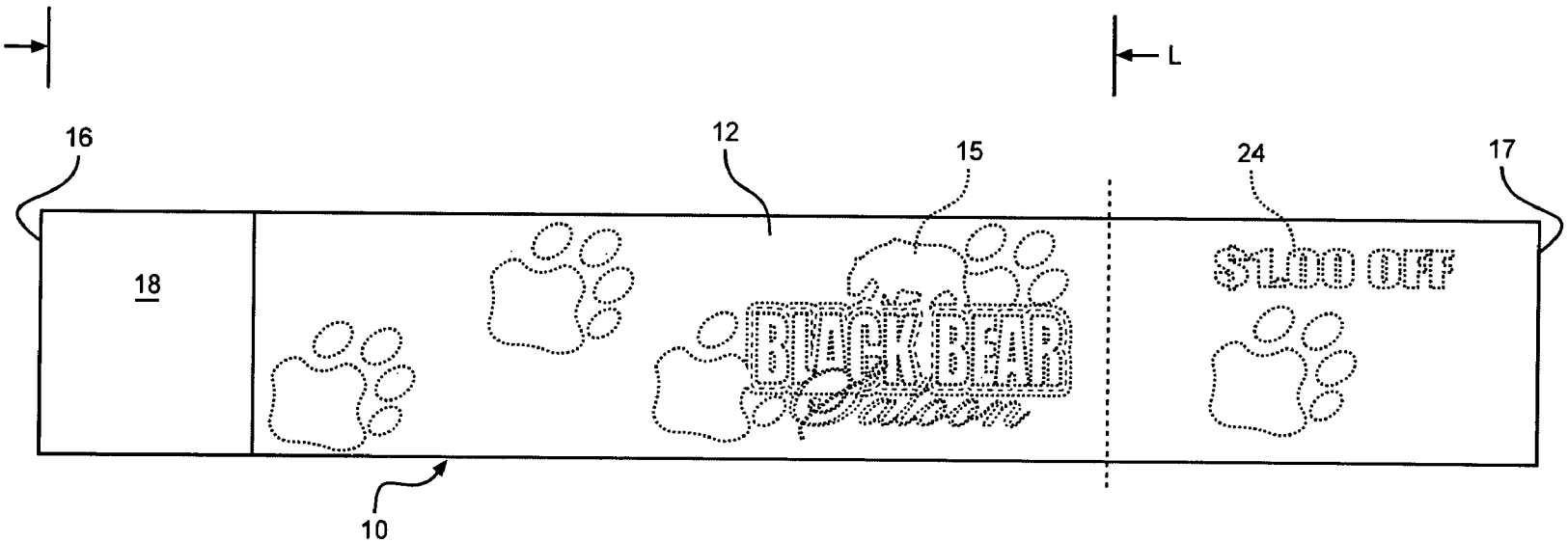
FIG. 1 is a top plan view of a strip of material that may be formed into a band about one or more articles or objects.
Figure 2:
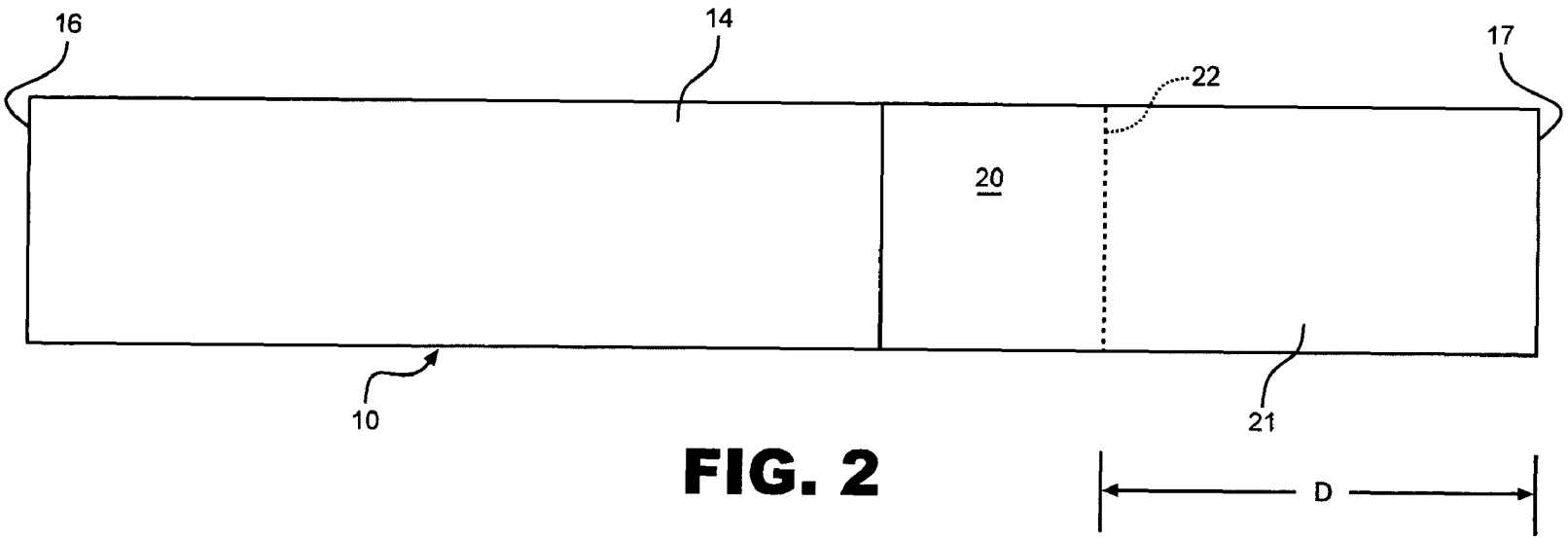
FIG. 2 if a bottom plan view of the strip of FIG. 1.
Figure 3:
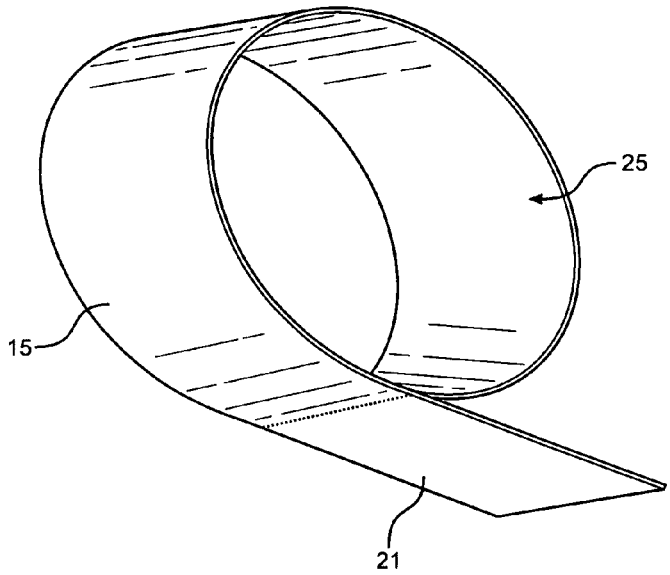
FIG. 3 is a perspective view showing the strip of material shown if FIGS. 1 and 2 formed into a band with the coupon portion thereof attached.
Figure 4:
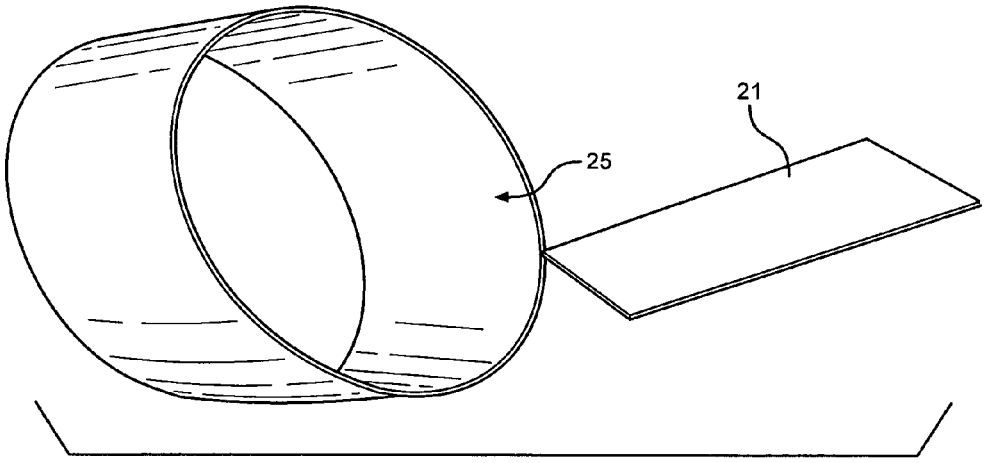
FIG. 4 is a perspective view showing the strip of material shown if FIGS. 1 and 2 formed into a band with the coupon portion thereof separated and ready for presentation.

With continued reference to the drawings, a paper or plastic strip 10 is shown having an upper surface 12 and lower surface 14. A first area of decoration or indicia 15 is applied, such as by convention printing processes, to a portion of the strip spaced inwardly from opposite first and second ends 16 and 17 of the strip. A first area 18 adjacent the first end 16 of the strip has a co-adhesive coating applied thereto which adhesive is of a type that will bind upon contact with a second adhesive area 20 on which a co-adhesive is applied to the lower surface of the strip. It should be noted that the second area 20 is spaced inwardly from the second end 17 of the strip.

In order to create a separable coupon or ticket section 21 along a portion of the strip, a line of weakness 22 is provided adjacent the second area of adhesive such that the distance "D" between the line of weakness and the second end of the strip defines a length of the separable coupon 21. The line of weakness may be formed by providing perforations or scoring across a width of the strip. The length "D" may vary depending upon the desired use of the coupon and the amount of indicia of advertising that is to be applies thereto. In this respect, a second area of decoration or indicia 24 is applied along the top surface of the strip and along the coupon or ticket portion 21 thereof. Generally, the indicia along the coupon or ticket portion 21 may relate to some service, item, prize, promotional event, discount, entry pass or the like. It is possible that the second area of decoration or indicia may be applied to the lower surface of the coupon or ticket portion of the strip or to both the upper and lower surfaces depending upon the appearance desired with respect to the coupon or ticket.

In use, the strip 10 is wrapped about an article to be bound, such as a napkin. The length "L" of the strip from the first end 16 to the line of weakness 22 will be determined based upon the size of article(s) to be bound by wrapping the strip about the article or articles. Once wrapped about the article(s), the first and second areas of co-adhesive are brought into contact with one another to thereby form the strip into a continuous band 25 with the first area of decoration or indicia displayed on the outer surface of the band. Thereafter, the coupon or ticket portion 21 of the strip 10 may be severed from the band for future use leaving the band completely in tact. In some circumstances, the coupon or ticket portion 21 of the band may be severed from the strip 10 before the strip is formed into the band 25. In some instances, the strip may be wrapped several times about the article or articles.

As previously noted, the material from which the strips 10 are formed should be such as to be capable of being ripped to permit a formed band to be readily removed from an article(s) that the band is wrapped around. However, in some instances, where it is desired that the wrapped band not be easily removable, the strips may be formed of a more durable plastic material that cannot be easily compromised or severed such that the resulting bands can only be severed using cutting devices such as knives or scissors.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. A flexible article encircling band for maintaining at least one article in a desired configuration, the flexible article encircling band comprising: a strip of material having first and second opposite ends and upper and lower surfaces, a first area of an adhesive positioned along a portion one of the upper and lower surfaces of the strip of material adjacent one of the first and second opposite ends thereof, a second area of adhesive positioned on the other of the upper and lower surfaces intermediate the first and second opposite ends, wherein the strip of material is formed into a circular band by securing the upper and lower surfaces together with the first and second areas of adhesive, the strip of material having a line of weakness extending across the strip of material and positioned between the second area of adhesive and the other of the opposite ends thereof such that a predetermined length of the strip of material between the line of weakness and the other of the opposite ends of the strip material may be severed from a remaining portion of the strip of material after the strip of material is formed into the circular band, wherein the predetermined length of material extends beyond an outer perimeter of the circular band and serves as a promotional item having a first area of indicia provided thereon.

2. The flexible article encircling band of claim 1 including a second area of indicia provided along the one of the upper and lower surfaces and intermediate the first area of adhesive and the line of weakness.

3. The flexible article encircling band of claim 2, wherein the first and second areas of indicia are provided along the same one of the upper and lower surfaces.

4. The flexible article encircling band of claim 3 wherein the first and second areas of indicia include related subject matters.

5. The flexible article encircling band of claim 4 wherein the predetermined length of the strip of material is a ticket.

6. The flexible article encircling band of claim 4 wherein the predetermined length of material is a promotional coupon.

7. The flexible article encircling band of claim 1 wherein the predetermined length of the strip of material is a ticket.

8. The flexible article encircling band of claim 1 wherein the predetermined length of material is a promotional coupon.

9. An article encircling device for maintaining at least one article in a desired configuration, the article encircling device comprising: a strip of material having upper and lower surfaces and first and second opposite ends, a first area of co-adhesive on the upper surface and a second area of co-adhesive on the lower surface and in spaced relationship from the first area, the strip of material being configured into a continuous band having a portion extending beyond an outer perimeter of the band, the band being retained in a shape of the continuous band by contacting the first and second co-adhesive areas with one another, and the portion of the strip material being separable from the continuous band along a line of weakness and serves as a promotional item having promotional indicial provided thereon.

10. The article encircling band of claim 9 wherein the portion of the strip material is a ticket.

11. The flexible article encircling band of claim 9 wherein the portion of the strip of material is a promotional coupon.

* * * * *